United States Patent [19]

Jacobson

[11] Patent Number: 4,879,782

[45] Date of Patent: Nov. 14, 1989

[54] BLIND CLEANING DEVICE

[76] Inventor: Jeff A. Jacobson, 409 Emerald Bay, Laguna Beach, Calif. 92651

[21] Appl. No.: 144,967

[22] Filed: Jan. 19, 1988

[51] Int. Cl.[4] ..... A47L 4/02

[52] U.S. Cl. ..... 15/210 A; 15/230.11; D4/120

[58] Field of Search ..... 15/210 A, 210 R, 230.11, 15/104 A, 211

[56] References Cited

U.S. PATENT DOCUMENTS

| | | | |
|---|---|---|---|
| 3,225,373 | 12/1965 | Kisbany | 15/104 A |
| 4,435,874 | 3/1984 | Jacobson | 15/210 A |
| 4,483,037 | 11/1984 | Jacobson | 15/210 A |
| 4,557,011 | 12/1985 | Sartori | 15/104 A |
| 4,570,280 | 2/1986 | Roth | 15/104 A |
| 4,718,141 | 1/1988 | Kuehnl | 15/210 A |

*Primary Examiner*—Edward L. Roberts

*Attorney, Agent, or Firm*—Bruce A. Jagger

[57] ABSTRACT

A blind cleaning device in which rollers are mounted on fingers which are designed to be projected between the slats of the venetian blinds. The rollers are retained on the fingers by means of a releasable detent means which is integral with and defines the end of the fingers. The rollers are mounted in a rotatable but interference fit on the fingers.

7 Claims, 5 Drawing Sheets

BLIND CLEANING DEVICE

This invention relates to blind cleaning devices and more particularly to blind cleaning devices of the type which include a plurality of cleaning rollers rotatably and releasably mounted on support fingers.

Prior blind cleaning devices include those illustrated, for example, in Jacobson U.S. Pat. No. 4,483,037.

This class of blind cleaning devices or tools utilizes a plurality of rollers which are covered with a loosely-compacted fibrous or spongy material which readily gathers and holds dust and dirt. In general, synthetic fibers are used in mat form as the dust-gathering medium on the exterior of the rollers. A plurality of rollers are provided in a configuration such that it is convenient to slide the bank of rollers between the slats in a Venetian blind. The portions of the rollers which contacts the blind of course gather the most dirt. From time to time it is desirable to either rotate the rollers to present a new cleaning surface or to remove the rollers from their mountings and wash them.

Previous expedients for mounting the rollers have not been entirely satisfactory in permitting either the rotation or the removal of the rollers. Cleaning devices such as that illustrated, for example, in Jacobson U.S. Pat. No. Des. 283,953, use conical tips to close the outer ends of the rollers so as to facilitate the insertion of the device into a Venetian blind. These tips are separable from the rollers and must be manufactured, inventoried and installed separately from the other components. This substantially increases manufacturing costs. The tips also may become dislodged during use or during washing, so as to provide an inconvenience to the user. Eliminating the tips entirely solves the problem of handling the separate tips, but sometimes presents difficulty in inserting the device into operable position in the VEnetian blind. Eliminating the tip does not solve the problem of providing an interference fit between the roller and the finger which will hold the roller on the finger yet permit it to be rotated when necessary.

In prior devices, the cleaning rollers are generally held in operable position on the tool by means of a friction fit between the roller and the finger which supports it. In order to prevent the rollers from becoming accidentally dislodged during use, there must be an interference fit which provides substantial resistance to rotational and longitudinal motion between the roller and the supporting finger. This friction or interference fit sometimes makes it difficult to rotate the roller to a new cleaning position or to remove it. Also, to accommodate both the desired retention and rotation functions, relatively close tolerances must be maintained. Further, the tolerances between the separate tip and the roller must be such that it is held firmly in place in the end of the roller. This requirement for the holding of relatively close tolerances increases the difficulty and expense of manufacturing in many different ways, from the selection of raw materials and the production of the tooling through the control of the production operations.

These and other difficulties of the prior art have been overcome according to the present invention which provides a blind cleaning device wherein the roller-supporting fingers are provided at their outer ends with integral detent means. The outer end of the finger is generally spearpoint-shaped, with the pointed end serving not only to guide the cleaning roller into operative position on the finger member, but also to guide the tool into operative position in the Venetion blind. The integral detent means holds the roller in operative position without regard to the effectiveness of the interference fit between the roller and the finger member. Since they are a part of the finger, the tips do not have to be made, installed, stocked and handled separately. Also, the tips cannot come off in use or in washing. Since the roller is held in operative position primarily by means of the integral detent member, the tolerances between the roller and the finger can be relaxed, with attention being focused on the rotatable function. The relaxed tolerances, which are possible through the use of an integral detent tip member, help permit the use of frictioninducing means which accommodate a wide variety of tolerance and still provide the desired function of permitting rotation of the rollers on the fingers when desired. Further, special friction inducing means are not required. The integral tip serves to keep the roller in place and wide range of tolerances between the roller and the finger will hold the roller against unintended rotation yet permit easy rotation when desired.

The fingers generally have a plus-shaped cross section and the rollers are slipped over and supported in contact with the rails, which are provided by the outer ends of the arms of the plus-shaped cross section. Other cross-sectional configurations may also be used if desired. The provision of radially-extending projections or bumps on the rails was previously utilized to provide an interference fit; see, for example, Jacobson U.S. Pat. No. Des. 274,147. It has been determined that if the leg is cut away below the bump so that the bump is not supported by a solid column of material, even greater variations in tolerances between the roller and the finger may be accommodated without substantially changing the feel of the interference fit between the roller and the finger. Also, it has been found that if bumps or projections are provided in staggered relationship to one another on generally opposing rails, very wide variations in tolerances may be accommodated without impairing the frictional fit between the roller and the finger. The arm may also be cut away radially inwardly from one or more of the staggered radially-projecting bumps, however, this is generally not necessary.

Reference to the accompanying figures is made for the purposes of illustration only and not limitation.

Figure 1:
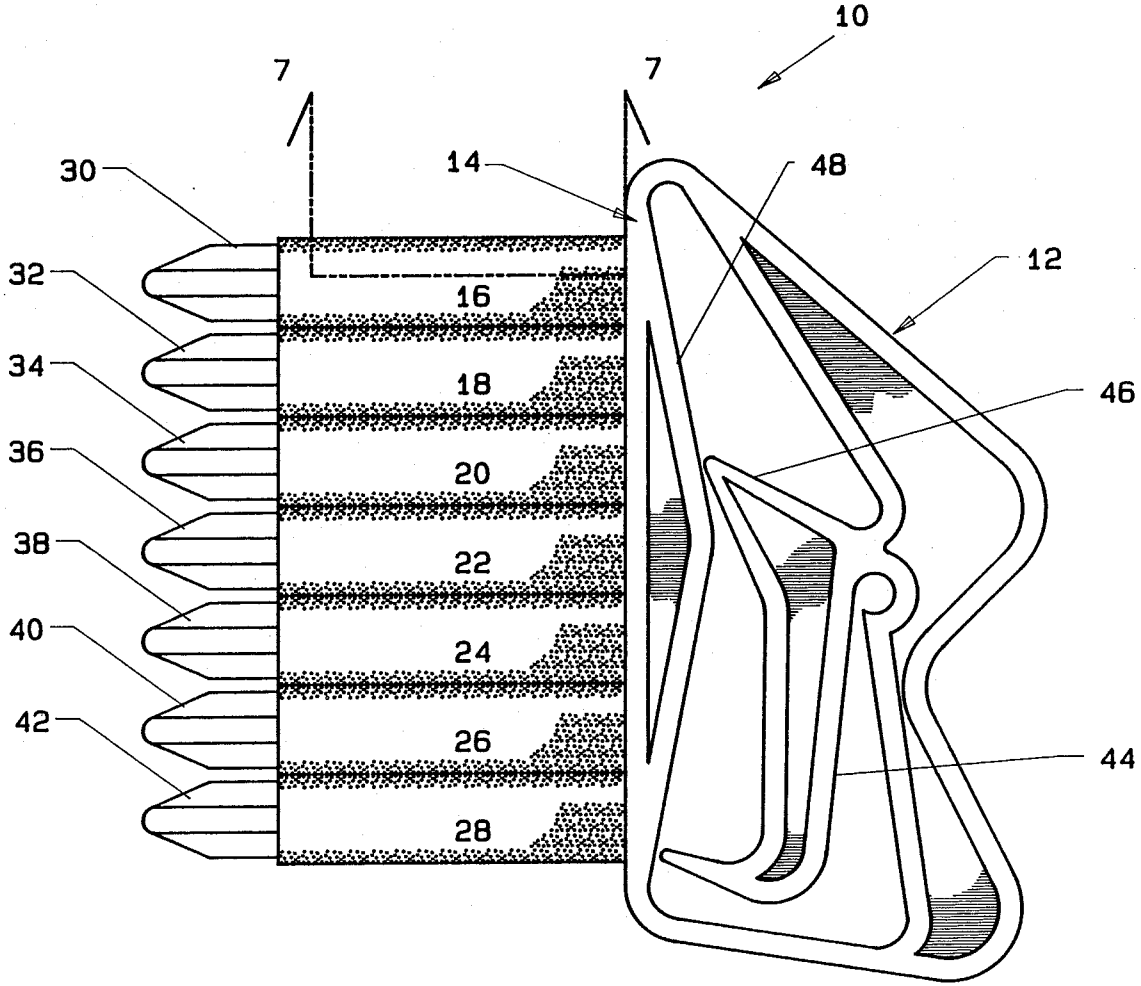
FIG. 1 is a plan view of a blind cleaning device utilizing roller-support fingers of the present invention.
Figure 2:
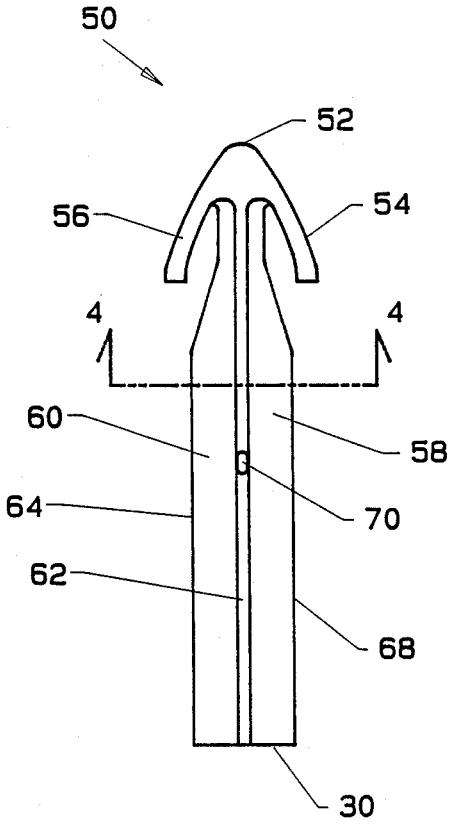
FIG. 2 is a plan view of a roller-support finger according to the present invention.
Figure 3:
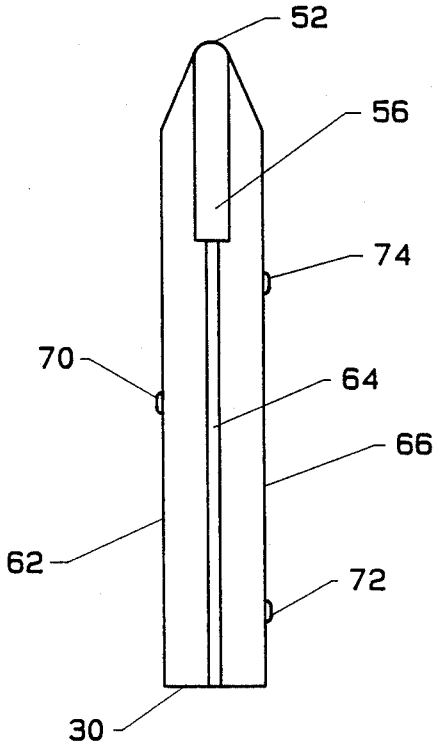
FIG. 3 is a side-elevational view of the finger illustrated in FIG. 2.

Referring particularly to the drawings, there is illustrated generally at 10 a blind cleaning device. Blind cleaning device 10 includes a handle 12 which is attached to a finger-mounting bar 14. Mounted to and projecting from finger-mounting bar 14 is an array of cleaning rollers 16, 18, 20, 22, 24, 26 and 28. The cleaning surfaces on the outer circumference of these rollers is preferably in the form of a shag 77. These cleaning rollers project outwardly from finger-mounting bar 14 and generally lie in a common plane with one another. The cleaning rollers are supported on fingers 30, 32, 34, 36, 38, 40 and 42. These fingers are generally rigidly mounted to finger-mounting bar 14 and provide the necessary support for the cleaning rollers. The particularly embodiment of handle which is illustrated in FIG. 1 is similar to that which is shown and described more fully in Jacobson U.S. Pat. No. 4,483,037, to which reference is made for purposes of a more complete description of the operation of the handle. Briefly, the handle 12 is provided with a trigger portion 44, which includes an actuating arm 46. Actuating arm 46 is positioned so that upon movement of trigger portion 44, the tip of actuating arm 46 rides along the ramp portion 48 of mounting bar 14 so as to cause the respective fingers to separate slightly at their outer ends. This facilitates positioning of the tool between the slats of the blind. When trigger 44 is relaxed, the rollers close together so as to pinch the slats between them.

The fingers are preferably substantially identical and extend approximately parallel to one another in a common plane. For purposes of illustration, finger 30 has been selected for description. Finger 30 includes an integral generally spearpoint-shaped detent member, which is indicated generally at 50. Detent member 50 is located at the remote outer-end of finger 30 from its attachment point to finger-mounting bar 14. Detent 50 is integral with the rest of finger 30 so that it cannot be separated short of destroying the finger. Tip 52 is generally a somewhatblunted point, which facilitates both the mounting of hollow roller 16 and the insertion of the tool into operative position in the blind. Flexible ears, shoulders or detent elements 54 and 56 depend from the region of tip 52. The radially outermost edges of the detent elements 54 and 56 normally extend radially outwardly further than the inner diameter of the cleaning roller. The arms 58 and 60 of finger 30 are undercut in the region of detent 50 so as to permit detent elements 54 and 56 to be depressed radially inwardly for a distance sufficient to permit cleaning roller 16 to slide over their radially outer edges and into position on the finger. When the cleaning roller is being installed during manufacturing, the cleaning roller itself depresses the detent elements 54 and 56. When the roller is to be removed for washing or replacements, the detent elements are provided with a broad enough outer surface so that they may be grasped and depressed by the operator's fingers. The material which is utilized in the construction of the fingers is selected so that there is sufficient resilience or springiness in the detent elements to permit this flexing for an extending number of cycles. In general the fingers are constructed from some solid phase organic polymeric material which is thermoplastic in nature.

Figure 4:
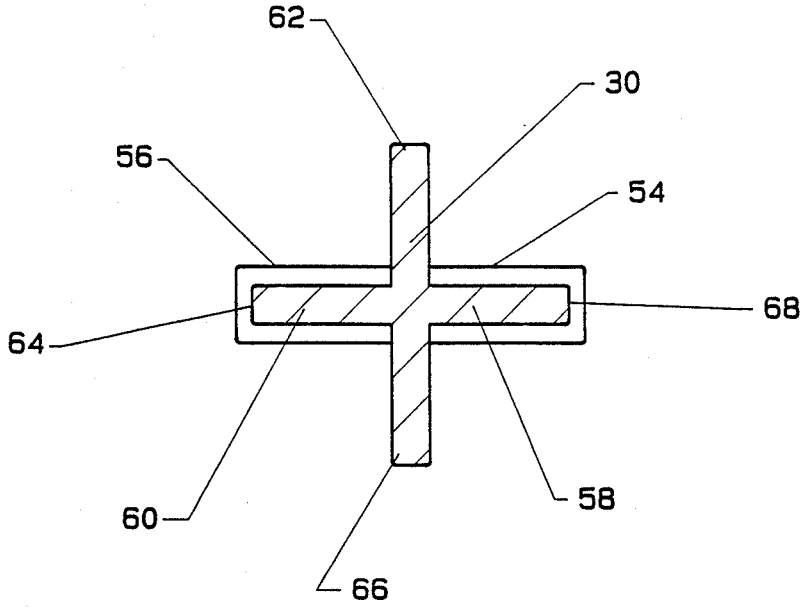
FIG. 4 is a cross-sectional view taken along the line 4—4 in FIG. 2.

The finger 30 has a generally plus-shaped cross section as indicated, for example, in FIG. 4, although other crosssectional forms with fewer or more arms or other forms may be used, if desired. The outer edges of the arms define rails 62, 64, 66 and 68, respectively. Structure is provided which permits an interference fit between finger 30 and cleaning roller 16. The interference fit is such that it prevents the roller from rotating while it is in use cleaning blinds, yet permits the roller to be rotated to present a new cleaning surface when desired by the operator. The structure which provides the frictional fit for cleaning roller 16 on finger 30 is designed to provide approximately the same interference fit throughout a wide range of dimensional variations between the roller and the finger. The structure which provides the interference fit comprises a radially-extending projection or bump 70, which is mounted to and extends radially outwardly from rail 62. Radiallyextending bumps or projections 72 an 74 project radially outwardly from rail 66. These projections 70, 72 and 74 engage the inner diameter of the hollow cylindrical cleaning roller 16. The projections 72 and 74 are staggered axially and spaced circumferentially from projection 70 so that the support cylinder 76 of the cleaning roller 16 is caused to flex and distort as it passes over the respective radial projections. The support cylinder 75 is sufficiently flexible and the radial projections are staggered longitudinally and circumferentially a sufficient distance apart so that approximately the same rotational resistance is provided to the roller throughout a wide range of rollerfinger mating dimensions. The user encounters approximately the same frictional fit throughout a wide range of such mating dimensions. Manufacturing costs are thus reduced substantially.

Figure 6:
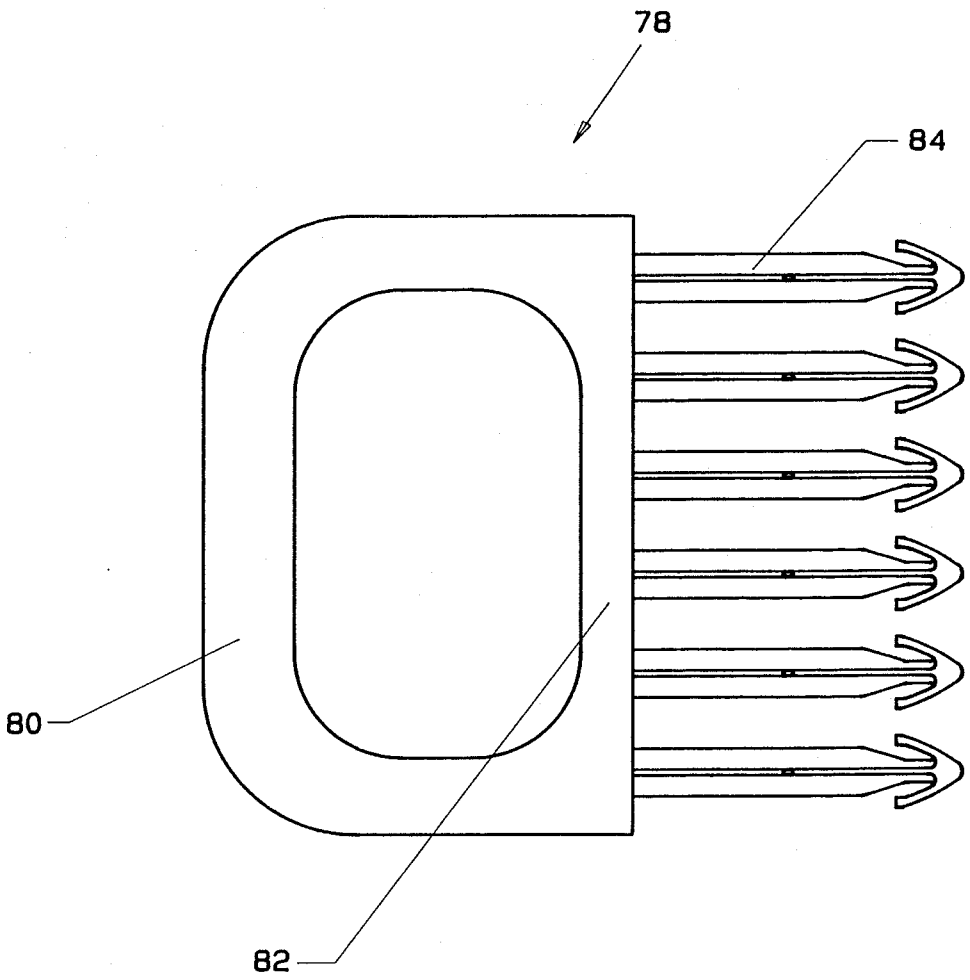
FIG. 6 is a plan view of a different blind cleaning device before the rollers are installed.

Referring particularly to FIG. 6, there is illustrated generally at 78 a blind cleaning device which consists of a handle 80, which is attached to a finger-mounting bar 82. Fingers project outwardly from bar 82. Finger 84 is illustrative of a typical finger. Radially-projecting, circumferentially and longitudinally-staggered projections are provided on finger 84. These function as previously described.

Figure 5:
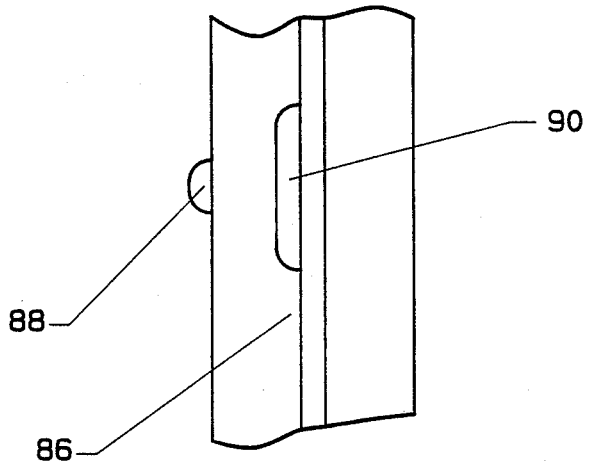
FIG. 5 is a broken view of an additional embodiment of a finger.
Figure 7:
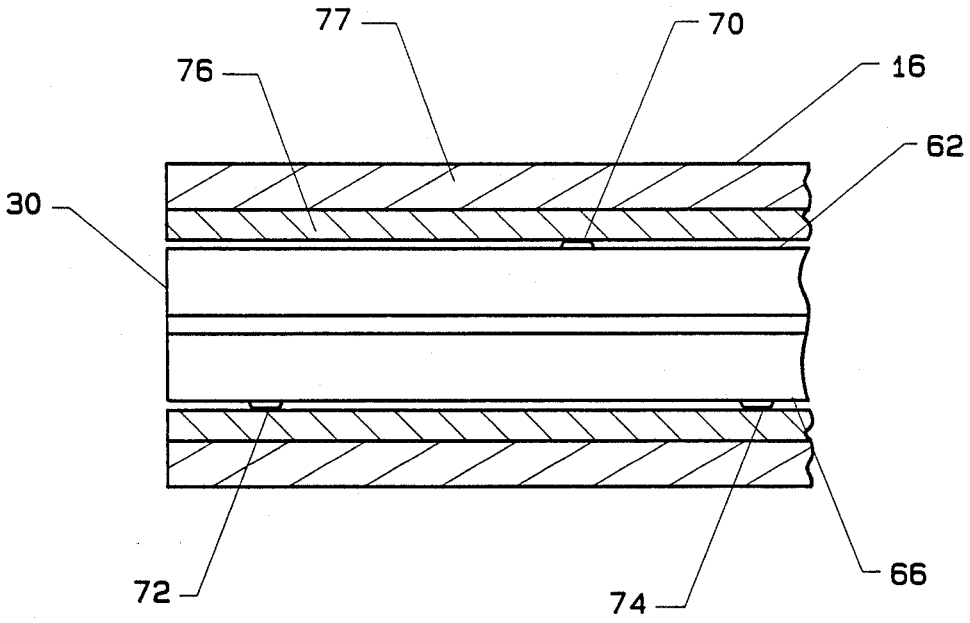
FIG. 7 is a cross-sectional view taken along the line 7—7 in FIG. 1.
Figure 8:
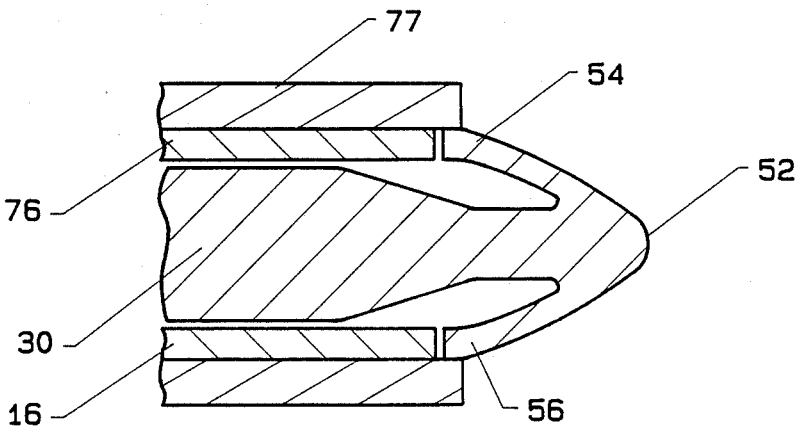
FIG. 8 is a cross-sectional view of the detent portion of a roller-finger assembly.

FIG. 5 illustrates a further embodiment of a structure for providing an approximately-uniform frictional engagement between the roller and the finger throughout a wide range of tolerances. A radial projection 88 is mounted on the outer rail of arm 86. Arm 86 is cut out immediately below projection 88 so as to permit some flexing of arm 86 in the region of radial projection 88. In this embodiment, the finger flexes radially under the projection. In the embodiment illustrated particularly in FIG. 7, the support cylinder 76 provides substantially all of the flexing, because the radial projections are supported by solid columns of material. Whether flexing is provided by the finger or by the support cylinder or by both is dictated in some part by the nature of the materials employed in the construction of these elements. In either embodiment, it is the resilience or springiness of the material which permits the accommodation of a wide range of dimensions between the finger and roller.

In use, the user grasps the handle of the tool and inserts the rollers into position between the slats of a Venetian blind. The pointed tips facilitate this insertion. The tool is moved back and forth along the length of the slats until the desired cleaning is effected. The tool is then withdrawn from contact with the blind. The mass of the cleaning material in the form of shag 77 tends to be drawn over the tip by the action of the blind slat so as to cover the detent elements and prevent them from snagging on the slats. Also, the detent elements are generally preferably oriented so as to minimize the opportunity for the detent elements to catch on the slats.

Taken in the aggregate, the features of the present invention provide a very satisfactory device which may be made and assembled inexpensively and with a minimum of labor, thus making this device economically competitive with devices which may be made with inexpensive hand labor. This is a substantial advantage to a domestic industry in competition against off-shore produced devices.

What have been described are preferred embodiments in which modifications and changes may be made without departing from the spirit and scope of the accompanying claims.

What is claimed is:

1. A blind cleaning device comprising:

a mounting bar member;

at least one axially-extending finger member mounted to and projecting from said mounting-bar member, said finger member having an integral detent means on an end which is remote from said mounting-bar member for releasably retaining a cleaning roller in operative position on said finger member, said finger member being adapted to slideably and rotatably support a generally-cylindrical axially-hollow cleaning roller in a frictional fit, said finger member being longer than said cleaning roller and being adapted to extend axially through said cleaning roller, and means for accommodating a wide variation in tolerance between said finger and cleaning roller without substantially changing said frictional fit; and means for grasping mounted to said mounting-bar member.

2. A blind cleaning device of claim 1 wherein said means for accommodating includes a generally resilient cleaning roller and a plurality of radially extending projections on said finger member, said projections being staggered relative to one another both axially and circumferentially along said finger, said projections being generally the radially outermost portion of said finger member exclusive of said detent means.

3. A handheld blind cleaning device of the type including a grasping element, at least one cleaning roller member, at least one finger member mounted to said grasping element and adapted to slideably and rotatably mount said cleaning-roller member in a frictional fit, and means for accommodating a wide variation in tolerance between said finger and cleaning roller without substantially changing said frictional fit, said means for accommodating including at least one radial projection mounted on a radially flexible portion of said finger member, said radial projection being adapted to contact the inner diameter of said cleaning roller.

4. A handheld blind cleaning device of claim 3 wherein said means for accommodating includes a resilient cleaning roller member.

5. A blind cleaning device comprising:

a mounting bar member;

at least two axially-extending finger members mounted to and projecting from said mounting-bar member, said finger members extending generally parallel with and adjacent to one another, said finger members each having an integral generally-spearshaped detent means on an end which is remote from said mounting-bar member for releasably retaining a cleaning roller in operative position on said finger member, said detent means being adapted to permit the slideable passage of said cleaning roller in one axial direction on to said finger member and to releasably prevent the removal of said cleaning roller from said finger member, each of said finger members being adapted to slideably and rotatably support a generally-cylindrical axially-hollow cleaning roller in an interference fit, said finger members being longer than said cleaning rollers and being adapted to extend axially through said cleaning rollers;

means for accommodating substantial variations in tolerances between said cleaning rollers and said finger members without substantially changing the feel of the interference fit between said cleaning rollers and said finger members; and means for grasping mounted to side mounting-bar member.

6. A cleaning device of claim 5 wherein said integral generally-spearshaped detent means terminates in an outwardly-projecting generally-pointed end from which two shoulders project outwardly and rearwardly, said shoulders terminating in edges which normally extend radially outwardly further than the inner diameter of said cleaning roller, said shoulders being resiliently radially deflectable to permit the passage of said cleaning roller thereover.

7. A cleaning device of claim 5 wherein said means for accommodating includes approximately-opposed axially staggered radial projections on said finger members, said projections being adapted to contact the inner diameter of said cleaning roller.

* * * * *